US006848482B2

(12) United States Patent
Moriyama

(10) Patent No.: US 6,848,482 B2
(45) Date of Patent: Feb. 1, 2005

(54) LIQUID REMOVING DEVICE

(75) Inventor: Yasuyuki Moriyama, Tokyo (JP)

(73) Assignee: Tetra Laval Holdings & Finance, S.A. (CH)

( * ) Notice: Subject to any disclaimer, the term of this patent is extended or adjusted under 35 U.S.C. 154(b) by 287 days.

(21) Appl. No.: 10/258,236

(22) PCT Filed: May 11, 2001

(86) PCT No.: PCT/JP01/03930

§ 371 (c)(1),
(2), (4) Date: Oct. 22, 2002

(87) PCT Pub. No.: WO01/85546

PCT Pub. Date: Nov. 15, 2001

(65) Prior Publication Data

US 2003/0116220 A1 Jun. 26, 2003

(30) Foreign Application Priority Data

May 12, 2000 (JP) ..... 2000-139505

(51) Int. Cl.[7] ..... B65B 1/04; B65B 65/08; A01N 9/00

(52) U.S. Cl. ..... 141/89; 141/85; 141/125; 53/167; 422/37

(58) Field of Search ..... 141/85, 89, 114, 141/121, 125; 118/65, 68; 134/15, 27; 53/167, 316; 422/37; 222/95–102

(56) References Cited

U.S. PATENT DOCUMENTS 3,383,831 A * 5/1968 Goldsmith et al. ..... 53/167
4,104,024 A * 8/1978 Vogele et al. ..... 422/37
5,511,696 A * 4/1996 Gustafson ..... 222/102

* cited by examiner

*Primary Examiner*—Timothy L. Maust
(74) *Attorney, Agent, or Firm*—Lorusso, Loud & Kelly

(57) ABSTRACT

An object is to provide a liquid-removing apparatus capable of sufficiently removing liquid adhering to packaging material (11). The liquid-removing apparatus includes a packaging material (11) having a projection formed at a predetermined position; first and second squeeze rollers (23, 33) which form a squeeze portion (P1) for removing liquid adhering to the packaging material (11); and an elastic body. The second squeeze roller (33) has main roller portions (53, 54) and a retractable roller portion (55) which retracts when the projection reaches the squeeze portion (P1). The elastic body urges a tubular sleeve (64) provided on the retractable roller portion (55) toward the packaging material (11). When the projection reaches the squeeze portion (P1) during transportation of the packaging material (11), the sleeve (64) is pushed by the projection and thereby decentered, so that the retractable roller portion (55) is retracted. As a result, interference between the projection and the second squeeze roller (33) is prevented, and the packaging material (11) can be nipped by the first and second squeeze rollers (22, 33).

8 Claims, 8 Drawing Sheets

LIQUID REMOVING DEVICE

TECHNICAL FIELD

The present invention relates to a liquid-removing apparatus.

BACKGROUND ART

In a conventional filling apparatus for manufacturing packaging containers filled with a liquid food such as milk or beverage, a web-shaped packaging material is continuously formed into a tubular shape by means of forming rollers, while being transported, and a liquid food is charged into the tubular packaging material to thereby form packaging containers.

Since a liquid food is charged into the tubular packaging material, from the viewpoint of sanitation, the web-shaped packaging material is sterilized before being formed into a tubular shape. For such a purpose, a sterilizing tank filled with a liquid bactericidal agent is disposed on the upstream side of the forming rollers with respect to the transport direction of the packaging material. The packaging material is passed through the sterilizing tank for immersion in the bactericidal agent.

When the packaging material passes through the sterilizing tank, the bactericidal agent adheres to the packaging material. Therefore, a liquid-removing apparatus is disposed on the downstream side of the sterilizing tank with respect to the transport direction of the packaging material. The liquid-removing apparatus includes a pair of squeeze rollers and an air knife. The rollers nip the packaging material, while applying a predetermined pressing force thereto, in order to squeeze the bactericidal agent from the packaging material. The air knife blows the bactericidal agent off the packaging material by means of hot air jetted therefrom.

However, the above-described conventional liquid-removing apparatus has the following drawback. When packaging materials which have mouthpieces on their top walls in order to enable drinking of liquid food are to be manufactured, the mouthpieces are bonded to the packaging material in advance. In such a case, since mouthpieces project from the surface of the packaging material, the mouthpieces interfere with the squeeze rollers. As a result, the squeeze rollers fail to nip the packaging material.

A conceivable measure for preventing interference between the mouthpieces and the squeeze rollers is forming a groove in the one of the squeeze rollers that faces the mouthpieces.

FIG. 1 is a view showing operation of a conventional liquid-removing apparatus.

In FIG. 1, reference numeral 11 denotes a packaging material transported in the direction indicated by arrow A; 22 denotes a mouthpiece; 23 denotes a first squeeze roller functioning as a backup roller; 24 denotes a second squeeze roller functioning as a pressure roller and disposed to face the first squeeze roller 23; and 25 denotes a groove formed on the second squeeze roller 24 to extend in the circumferential direction thereof. The depth of the groove 25 is set to be slightly greater than the height of the mouthpiece 22. The groove 25 is formed at a predetermined position along the axial direction of the second squeeze roller 24 such that the groove 25 faces the mouthpieces 22 on the packaging material 11.

When the packaging material 11 is transported and a certain portion of the packaging material 11 reaches the point between the first and second squeeze rollers 23 and 24, the certain portion of the packaging material 11 is nipped by the first and second squeeze rollers 23 and 24 with a predetermined pressing force. As a result, a bactericidal agent adhering to the packaging material 11 is removed. When one of the mouthpieces 22 passes through the space between the first and second squeeze rollers 23 and 24, the mouthpiece 22 is received by the groove 25, so that interference between the mouthpiece 22 and the second squeeze roller 24 can be prevented.

However, when the first and second squeeze rollers 23 and 24 squeeze the bactericidal agent from the packaging material 11, no pressing force is applied to the packaging material 11 in an area corresponding to the groove 25 formed in the second squeeze roller 24. Therefore, the bactericidal agent cannot be removed from the portion of the packaging material 11 corresponding to the groove 25.

An object of the present invention is to provide a liquid-removing apparatus capable of solving the problems involved in the conventional liquid-removing apparatus and capable of sufficiently removing liquid adhering to packaging material.

DISCLOSURE OF THE INVENTION

To achieve the above object, the present invention provides a liquid-removing apparatus which comprises a packaging material having a projection formed at a predetermined position; first and second squeeze rollers which form a squeeze portion for removing liquid adhering to the packaging material; and an elastic body.

The second squeeze roller has a main roller portion and a retractable roller portion which retracts when the projection reaches the squeeze portion. The elastic body urges a tubular sleeve provided on the retractable roller portion toward the packaging material.

When the projection reaches the squeeze portion during transportation of the packaging material, the sleeve is pushed by the projection and thereby decentered, so that the retractable roller portion is retracted. As a result, interference between the projection and the second squeeze roller is prevented, and the packaging material can be nipped by the first and second squeeze rollers. Therefore, liquid adhering to the packaging material can be removed to a sufficient degree.

In another liquid-removing apparatus of the present invention, the retractable roller portion is disposed between a pair of the main roller portions.

In still another liquid-removing apparatus of the present invention, the sleeve is supported by the elastic body in a floating state.

In still another liquid-removing apparatus of the present invention, the elastic body is disposed between the sleeve and a support member of said main roller portion.

In still another liquid-removing apparatus of the present invention, the main roller portion and the retractable roller portion are rotatably supported on a common shaft.

In still another liquid-removing apparatus of the present invention, the main roller portion and the retractable roller portion have individual shafts disposed independently of one another.

In still another liquid-removing apparatus of the present invention, the retractable roller portion is pivoted about a pivot shaft serving as a pivoting center.

In still another liquid-removing apparatus of the present invention, the shaft of the retractable roller portion is supported to be movable along a predetermined direction.

BEST MODE FOR CARRYING OUT THE INVENTION

Embodiments of the present invention will next be described in detail with reference to the drawings.

Figure 1:
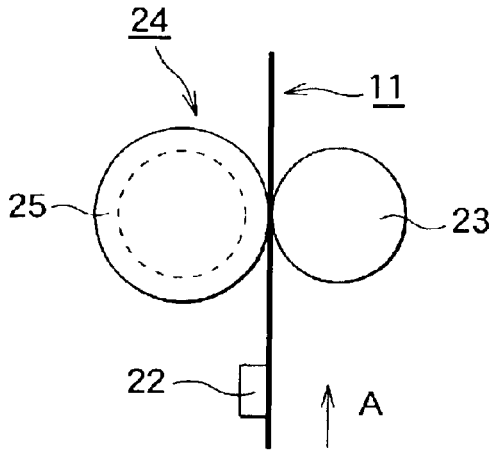
FIG. 1 is a view showing operation of a conventional liquid-removing apparatus.
Figure 2:
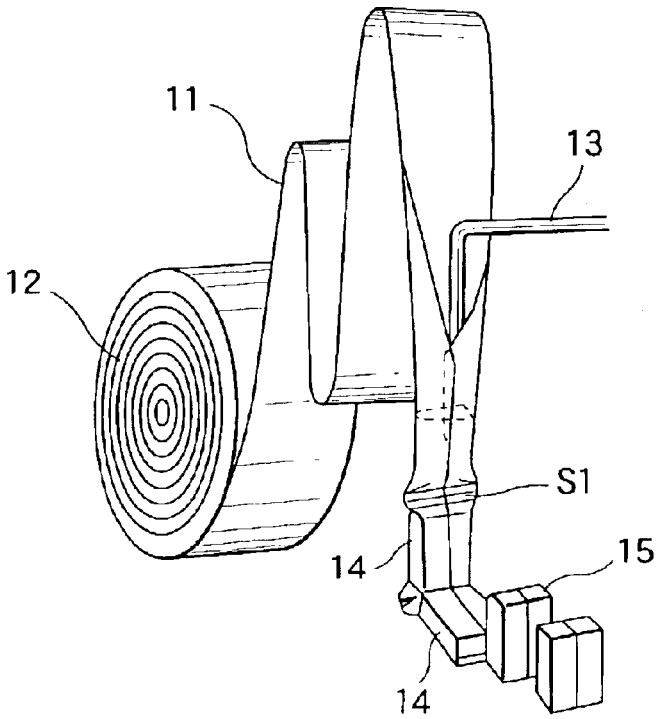
FIG. 2 is a schematic view of a filling machine according to a first embodiment of the present invention.

FIG. 2 is a schematic view of a filling machine according to a first embodiment of the present invention.

In FIG. 2, reference numeral 11 denotes a packaging material composed of, for example, an unillustrated paper substrate, and a resin layer for covering the surface of the paper substrate. The packaging material 11 is set on the filling machine in the form of a roll 12. The packaging material 11 is paid out by means of an unillustrated feeder and is transported within the filling machine, while assuming a web-like shape.

Subsequently, by means of unillustrated guide and forming rollers, the web-shaped packaging material 11 is gradually curved into a tubular shape, while being guided. Subsequently, the packaging material 11 is sealed longitudinally by means of an unillustrated longitudinal sealing unit. While the tubular packaging material 11 is being transported downward, a liquid food is supplied to the packaging material 11 from above via a filling pipe 13 to thereby charge the liquid food into the packaging material 11. Subsequently, the packaging material 11 is nipped from both sides thereof and sealed laterally at predetermined intervals. Thus, a semi-finished package 14 having a pillow-like or bag-like shape is formed.

Subsequently, a laterally extending seal portion S1 is cut so as to separate the semi-finished package 14. The semi-finished package 14 is then formed into a predetermined shape along previously formed crease lines to thereby complete a packaging container 15.

In the above-described filling machine, since a liquid food is charged into the tubular packaging material 11, from the viewpoint of sanitation, the web-shaped packaging material 11 is sterilized before being formed into a tubular shape. For such a purpose, an unillustrated sterilizing tank filled with a bactericidal agent as a liquid is disposed on the upstream side of the forming rollers with respect to the transport direction of the packaging material 11. The packaging material 11 is passed through the sterilizing tank such that the packaging material is immersed in the bactericidal agent.

When the packaging material 11 passes through the sterilizing tank, the bactericidal agent adheres to the packaging material 11. Therefore, an unillustrated liquid-removing apparatus is disposed on the downstream side of the sterilizing tank with respect to the transport direction of the packaging material 11.

Next, the liquid-removing apparatus will be described.

Figure 3:
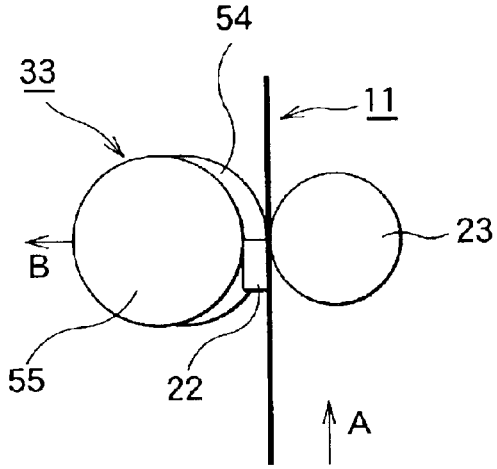
FIG. 3 is a view showing operation of a liquid-removing apparatus according to the first embodiment of the present invention.
Figure 4:
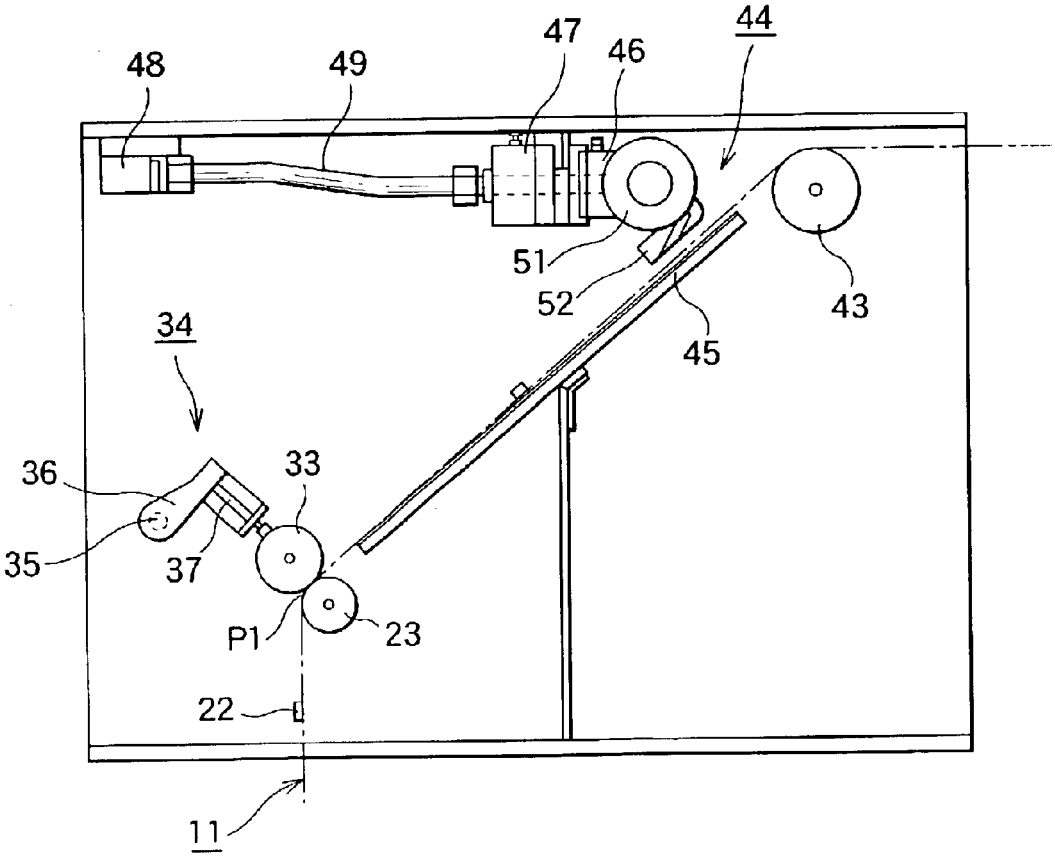
FIG. 4 is a schematic view of the liquid-removing apparatus according to the first embodiment of the present invention.
Figure 5:
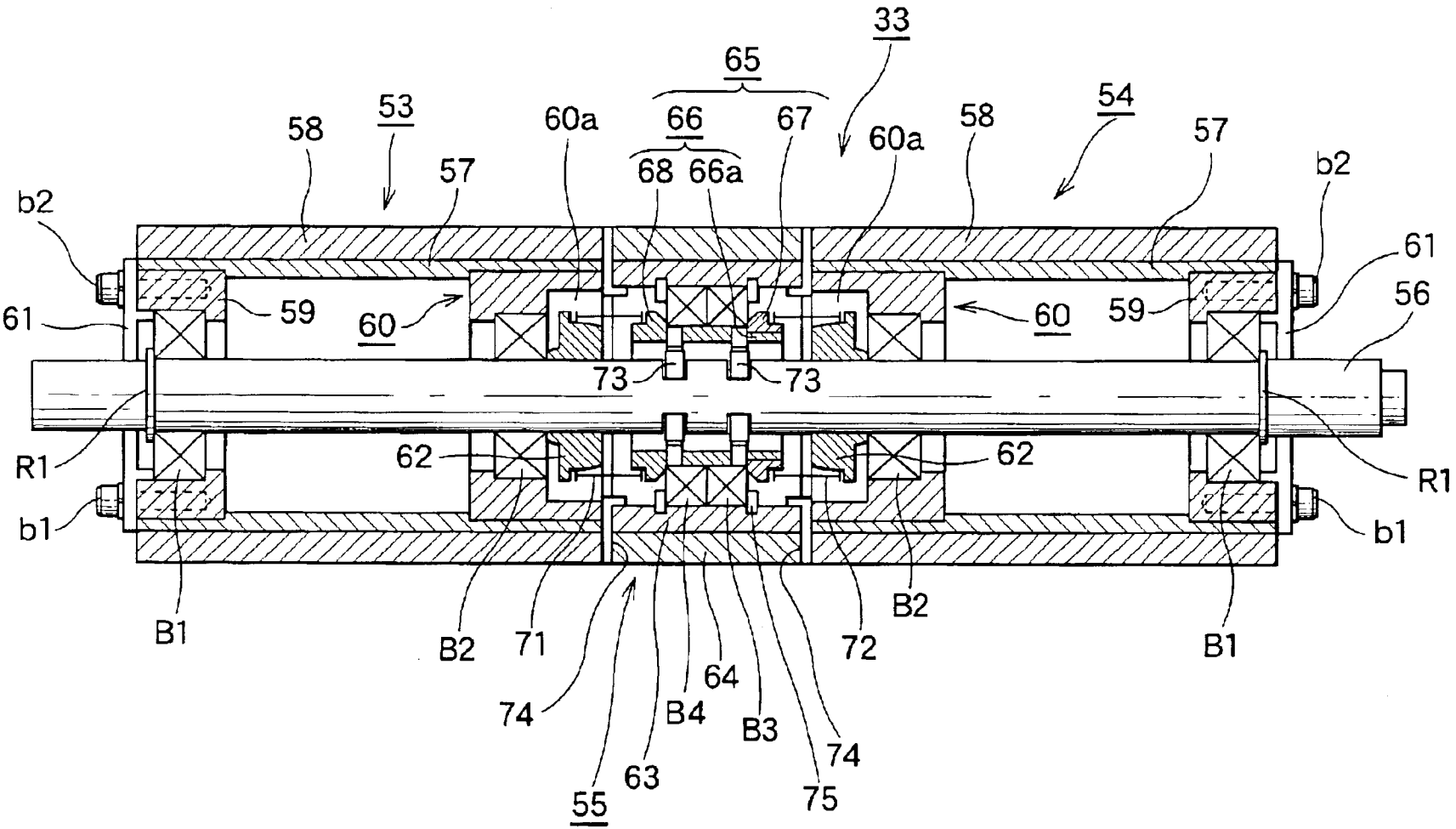
FIG. 5 is a longitudinal cross section of a second squeeze roller used in the first embodiment of the present invention.
Figure 6:
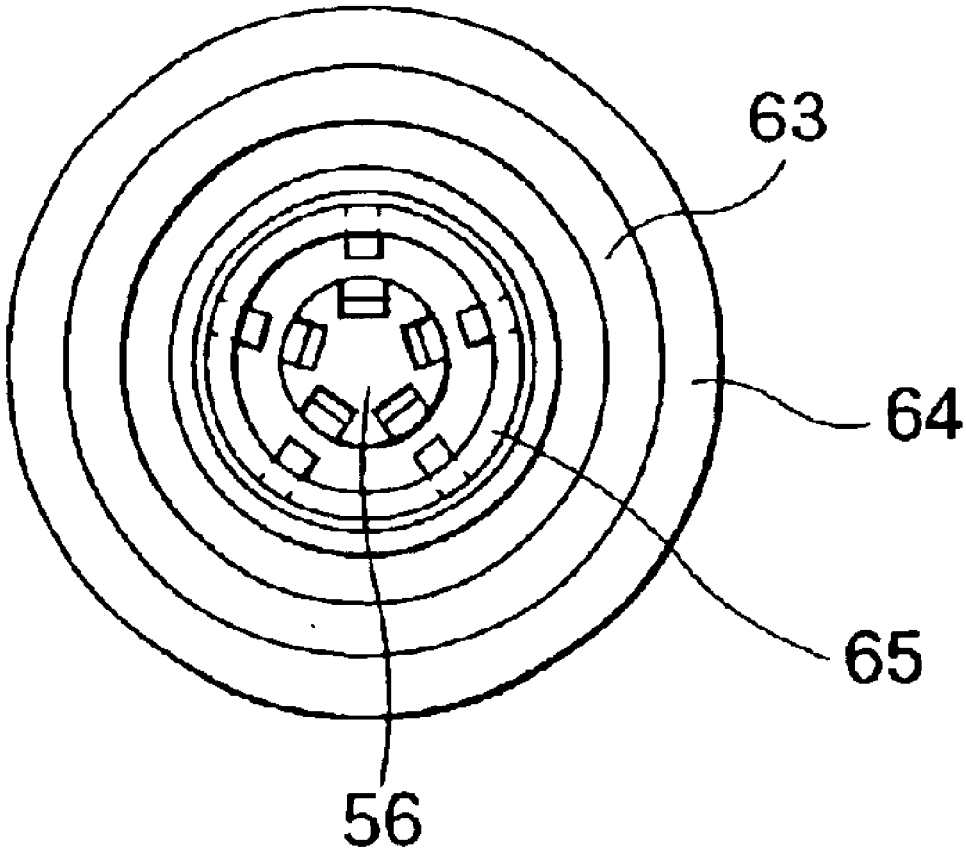
FIG. 6 is a transverse cross section of the second squeeze roller used in the first embodiment of the present invention.

FIG. 3 is a view showing operation of a liquid-removing apparatus according to the first embodiment of the present invention. FIG. 4 is a schematic view of the liquid-removing apparatus according to the first embodiment of the present invention. FIG. 5 is a longitudinal cross section of a second squeeze roller used in the first embodiment of the present invention. FIG. 6 is a transverse cross section of the second squeeze roller used in the first embodiment of the present invention.

In these drawings, reference numeral 11 denotes a packaging material transported in the direction indicated by arrow A. A mouthpiece 22 for enabling drinking of liquid food is attached to the top wall of the packaging container 15 (shown in FIG. 2), which is formed from the packaging material 11. The mouthpiece 22 is previously attached, at each of predetermined positions, to the packaging material 11, so that the mouthpiece 22 projects from the surface of the packaging material 11 and serves as a projection.

Reference numeral 23 denotes a first squeeze roller functioning as a backup roller; 33 denotes a second squeeze roller functioning as a pressure roller, which is disposed to face the first squeeze roller 23; 34 denotes a pressing mechanism for pressing the second squeeze roller 33 against the first squeeze roller 23 with a predetermined pressing force; 43 denotes a transport roller for transporting a portion of the packaging material 11 from which the bactericidal agent has been removed; and 45 denotes a stage disposed between the first squeeze roller 23 and the transport roller 43 and adapted to support the packaging material 11 from below.

A squeeze portion P1 is formed between the first and second squeeze rollers 23 and 33. The first and second squeeze rollers 23 and 33 nip the packaging material 11 at the squeeze portion P1. The first squeeze roller 23 is connected to an unillustrated motor serving as drive means. When the motor is operated, the first squeeze roller 23 rotates, and the second squeeze roller 33 rotates to follow the first squeeze roller 23, to thereby transport the packaging material 11. The pressing mechanism 34 includes an arm 36 disposed to be pivotable about a shaft 35, and a pusher 37 attached to a distal end of the arm 36 and adapted to push the second squeeze roller 33 toward the first squeeze roller 23.

When the packaging material 11 is transported and a certain portion of the packaging material 11 reaches the squeeze portion P1, the certain portion of the packaging material 11 is nipped by the first and second squeeze rollers 23 and 33. Since the second squeeze roller 33 is pushed toward the first squeeze roller 23 by the pusher 37 with a predetermined pressing force, the bactericidal agent adhering to the packaging material is removed.

An air knife 44 is disposed on the downstream side of the squeeze portion P1 with respect to the transport direction of the packaging material 11 such that the air knife 44 extends over the entire width of the packaging material 11. The air knife 44 jets hot air toward the packaging material 11 with a predetermined air pressure. More specifically, the air knife 44 includes an air knife body 51 extending in the width direction of the packaging material 11 and connected to a manifold 46; and an air-blowing slit 52 for jetting toward the surface of the packaging material 11 the hot air supplied to the air knife body 51. The air knife 44 is connected to an unillustrated hot air source via the manifold 46, connection members 47 and 48, and a connection pipe 49.

Accordingly, when hot air generated by the hot air source is supplied to the air knife body 51 via the connection member 48, the connection pipe 49, the connection member 47, and the manifold 46 and is jetted from the air-blowing slit 52, the bactericidal agent can be blown off the surface of the packaging material 11, and the surface of the packaging material 11 can be dried.

As described above, when the packaging containers 15, which have mouthpieces 22 on their top walls in order to enable drinking of liquid food, are to be manufactured, the mouthpieces 22 are bonded to the packaging material 11 in advance. In such a case, since the mouthpieces 22 project from the surface of the packaging material 11, the mouthpieces 22 interfere with the second squeeze roller 33. As a result, the first and second squeeze rollers 22 and 33 fail to nip the packaging material 11.

In view of the foregoing, in the present embodiment, the second squeeze roller 33 includes a pair of main roller portions 53 and 54 and a retractable roller portion 55, which are rotatably supported on a common shaft 56. The main roller portions 53 and 54 extend from opposite axial ends of the shaft 56 toward a center portion thereof and are always pressed toward the first squeeze roller 23, so that the main roller portions 53 and 54 come into contact with the first squeeze roller 23 directly or via the packaging material 11. The retractable roller portion 55 is disposed at a predetermined position relative to the main roller portions 53 and 54 (at the center in the present embodiment). When a mouthpiece 22 reaches the squeeze portion P1 during transport of the packaging material 11, the retractable roller portion 55 is pushed to thereby separate from the surface of the packaging material 11 and retract in the direction of arrow B.

Each of the main roller portions 53 and 54 includes a tubular support member 57; a tubular sleeve 58, which covers the outer circumferential surface of the support member 57 and has on its outer circumference a squeeze surface which comes into contact with the packaging material 11; a first tubular hub 59, which is disposed inside the support member 57 to be located at a corresponding end of the second squeeze roller 33; a second tubular hub 60, which is disposed inside the support member 57 to be located adjacent to the retractable roller portion 55; a bearing B1 fitted between the shaft 56 and the first tubular hub 59; a bearing B2 fitted between the shaft 56 and the second tubular hub 60; an annular cap 61, which is fixed to the first tubular hub 59 and covers the bearing B1; and an annular support member 62 for supporting the retractable roller portion 55 independently of the main roller portions 53 and 54. The cap 61 is fixed to the first tubular hub 59 by use of bolts b1 and b2. A concave portion 60*a* is formed in a surface of the second tubular hub 60 facing the retractable roller portion 55. The support member 62 is received within the concave portion 60*a* and is fixed to the shaft 56. Reference letter RI denotes a snap ring which is attached to the shaft 56 in order to prevent movement of the bearing B1 along the axial direction of the shaft 56.

The retractable roller portion 55 includes a tubular support member 63; a tubular sleeve 64, which covers the outer circumferential surface of the support member 63 and has on its outer circumference a squeeze surface which comes into contact with the packaging material 11; bearings B3 and B4, which are disposed inside the support member 63 in such a manner that the bearings B3 and B4 are located adjacent to each other at a substantially center portion of the support member 63; and a tubular floating sleeve 65 disposed radially inside the bearings B3 and B4.

The floating sleeve 65 is composed of a tubular body 66 and a flange 67. The tubular body 66 has a flange 68 at one end portion located on the side of the main roller portion 53 and a threaded portion 66*a* at the opposite end portion located on the side of the main roller portion 54. The flange 67 is screwed onto the threaded portion 66*a*. The floating sleeve 65 is supported by springs 71, 72, and 73, serving as first, second, and third elastic bodies, respectively. The spring 71 is disposed between the flange 68 and the support member 62 of the main roller portion 53. The spring 72 is disposed between the flange 67 and the support member 62 of the main roller potion 54. The spring 73 is disposed between the tubular body 66 and the shaft 56. Therefore, the sleeve 64 is supported in a floating state to be movable relative to the shaft 56 and urged toward the packaging material 11. At each of two axial locations, the spring 73 is disposed on the shaft 56 at each of five circumferential locations. Therefore, depressions for supporting opposite ends of the spring 73 are formed on the tubular body 66 and the shaft 56. Notably, reference numeral 74 denotes slide plates disposed at opposite ends of the support member 63 and the sleeve 64 in order to reduce friction force generated between the support member 57 and the sleeve 58 and the support member 63 and the sleeve 64; and reference numeral 75 denotes a snap ring for positioning the bearings B3 and B4.

The sleeves 58 of the main roller portions 53 and 54 are disposed concentrically with the shaft 56. When no external force acts on the sleeve 64 of the retractable roller portion 55, the sleeve 64 is disposed concentrically with the shaft 56 by means of the respective urging forces of the springs 71 to 73. When an external force acts on the sleeve 64, the sleeve 64 is decentered with respect to the shaft 56 against the respective urging forces of the springs 71 to 73.

Therefore, when the mouthpiece 22 reaches the squeeze portion P1 during transportation of the packaging material 11, the sleeve 64 is pushed by the mouthpiece 22 and thereby decentered with respect to the shaft 56, so that the retractable roller portion 55 is retracted. As a result, interference between the mouthpiece 22 and the second squeeze roller 33 is prevented, and the packaging material 11 can be nipped by the first and second squeeze rollers 23 and 33. Therefore the bactericidal agent adhering to the packaging material 11 can be removed to a sufficient degree.

Next, a second embodiment of the present invention will be described. Components having the same structures as those in the first embodiment are denoted by the same reference numerals, and repeated descriptions thereof are omitted.

Figure 7:
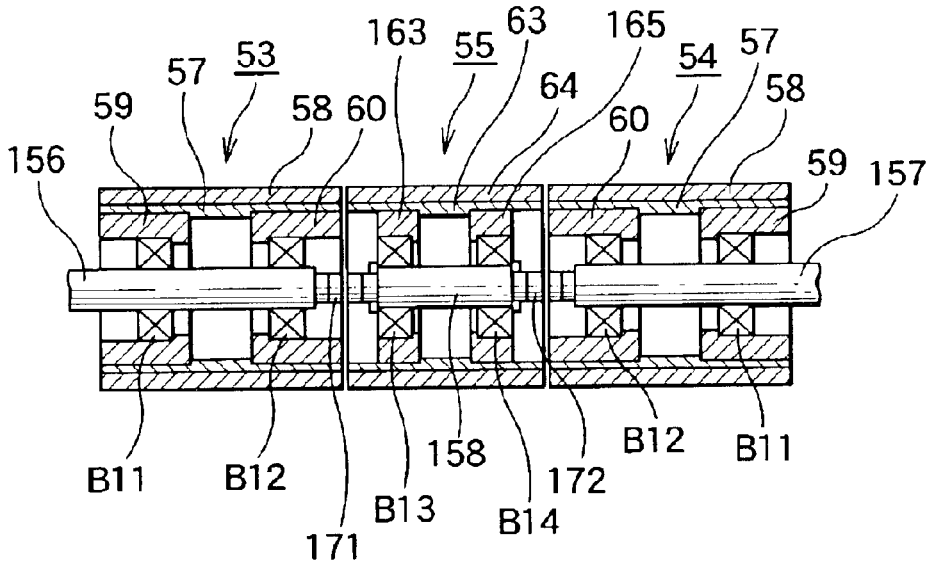
FIG. 7 is a longitudinal cross section of the second squeeze roller used in a second embodiment of the present invention.

FIG. 7 is a longitudinal cross section of the second squeeze roller used in the second embodiment of the present invention.

In the present embodiment, independent shafts 156 to 158 are provided for the main roller portions 53 and 54, and the retractable roller portion 55, respectively. A bearing B11 is disposed between the shaft 156 and the first tubular hub 59 of the main roller portion 53, and another bearing B11 is disposed between the shaft 157 and the first tubular hub 59 of the main roller portion 54. A bearing B12 is disposed between the shaft 156 and the second tubular hub 60 of the main roller portion 53, and another bearing B12 is disposed between the shaft 157 and the second tubular hub 60 of the main roller portion 54. A bearing B13 is disposed between the shaft 158 and a tubular hub 163, and a bearing B14 is disposed between the shaft 158 and a tubular hub 165.

A spring 171 serving as a first elastic body is disposed between the shafts 156 and 158. A spring 172 serving as a second elastic body is disposed between the shafts 157 and 158. Thus, the sleeve 64 is supported in a floating state to be movable relative to the shafts 156 and 157, and urged toward the packaging material 11 (FIG. 3).

The sleeves 58 of the main roller portions 53 and 54 are disposed concentrically with the shafts 156 and 157, respectively. When no external force acts on the sleeve 64 of the retractable roller portion 55, the sleeve 64 is disposed concentrically with the shaft 158 by means of the respective urging forces of the springs 171 and 172. When an external force acts on the sleeve 64, the sleeve 64 is decentered with respect to the shaft 158 against the respective urging forces of the springs 171 and 172.

Therefore, when the mouthpiece 22 reaches the squeeze portion P1 during transportation of the packaging material 11, the sleeve 64 is pushed by the mouthpiece 22 and thereby decentered with respect to the shaft 158, so that the retractable roller portion 55 is retracted.

Next, a third embodiment of the present invention will be described. Components having the same structures as those in the first embodiment are denoted by the same reference numerals, and repeated descriptions thereof are omitted.

Figure 8:
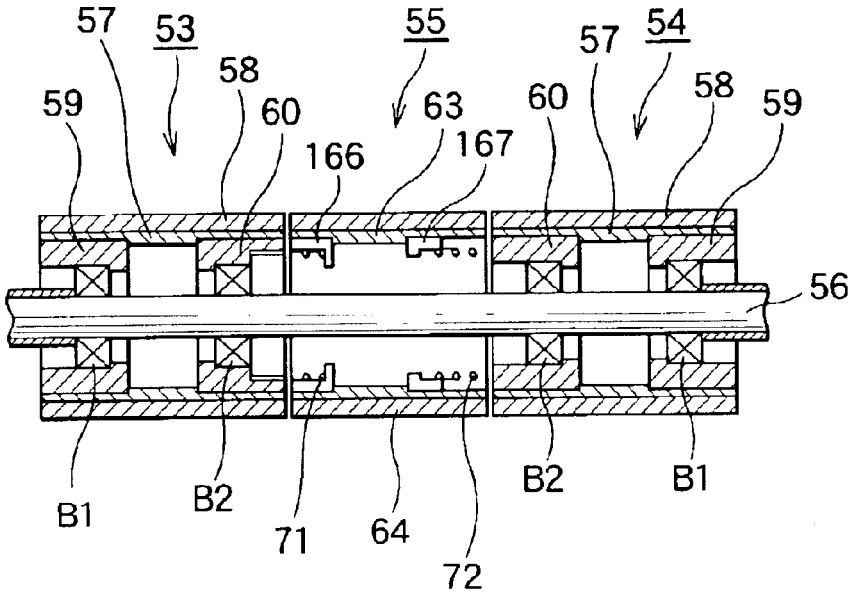
FIG. 8 is a longitudinal cross section of the second squeeze roller used in a third embodiment of the present invention.

FIG. 8 is a longitudinal cross section of the second squeeze roller used in the third embodiment of the present invention.

In the present embodiment, brackets 166 and 167 are disposed on the inner circumferential surface of the sleeve 64 to be located at opposite ends thereof. A spring 71 serving as a first elastic body is disposed between the bracket 166 and the second tubular hub 60 of the main roller portion 53. A spring 72 serving as a second elastic body is disposed between the bracket 167 and the second tubular hub 60 of the main roller portion 54. Thus, the sleeve 64 is supported in a floating state to be movable relative to the shaft 56, and urged toward the packaging material 11 (FIG. 3).

Next, a fourth embodiment of the present invention will be described. Components having the same structures as those in the second embodiment are denoted by the same reference numerals, and repeated descriptions thereof are omitted.

Figure 9:
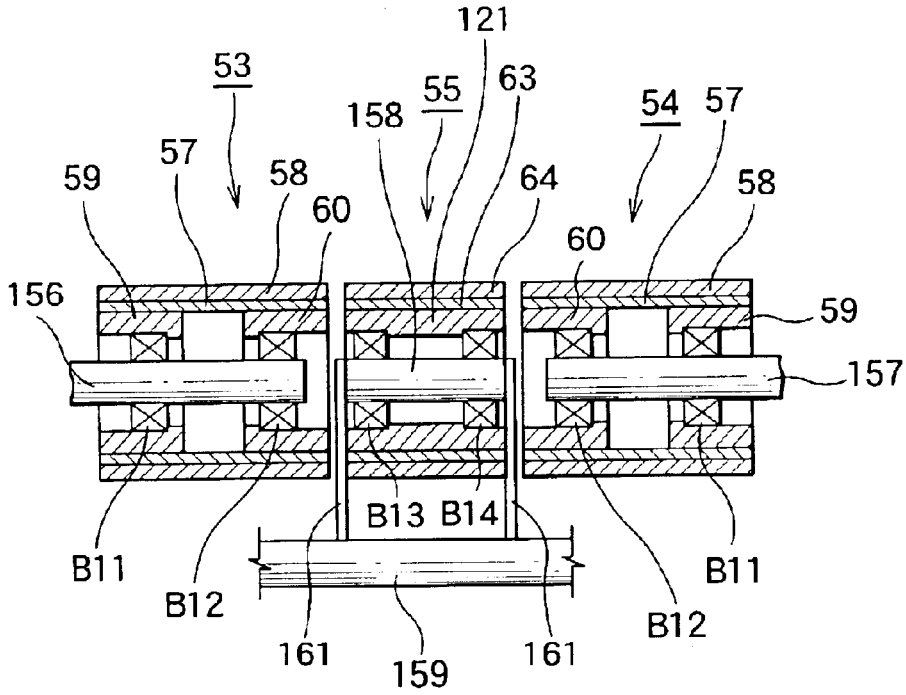
FIG. 9 is a longitudinal cross section of the second squeeze roller used in a fourth embodiment of the present invention.
Figure 10:
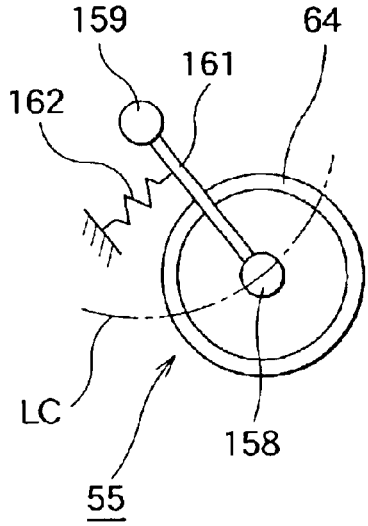
FIG. 10 is a transverse cross section of the second squeeze roller used in the fourth embodiment of the present invention.

FIG. 9 is a longitudinal cross section of the second squeeze roller used in the fourth embodiment of the present invention. FIG. 10 is a transverse cross section of the second squeeze roller used in the fourth embodiment of the present invention.

In the present embodiment, a tubular body 121 is disposed inside the support member 63 to extend along the inner circumferential surface thereof; and bearings B13 and B14 are disposed between the tubular body 121 and the shaft 158. Further, a pivot shaft 159 is disposed parallel to the shaft 158; and the shaft 158 is disposed in such a manner that it can pivot relative to the pivot shaft 159 serving as a pivoting center so as to move along a locus LC. For such operation, the pivot shaft 159 and the shaft 158 are connected to each other via a pair of arms 161; and the arms 161 are urged by a spring 162 serving as an elastic body toward a direction for pressing the retractable roller portion 55 against the first squeeze roller 23 (FIG. 3). Therefore, the sleeve 64 is supported in a floating state to be movable relative to the shafts 156 and 157, and urged toward the packaging material 11.

Next, a fifth embodiment of the present invention will be described. Components having the same structures as those in the second embodiment are denoted by the same reference numerals, and repeated descriptions thereof are omitted.

Figure 11:
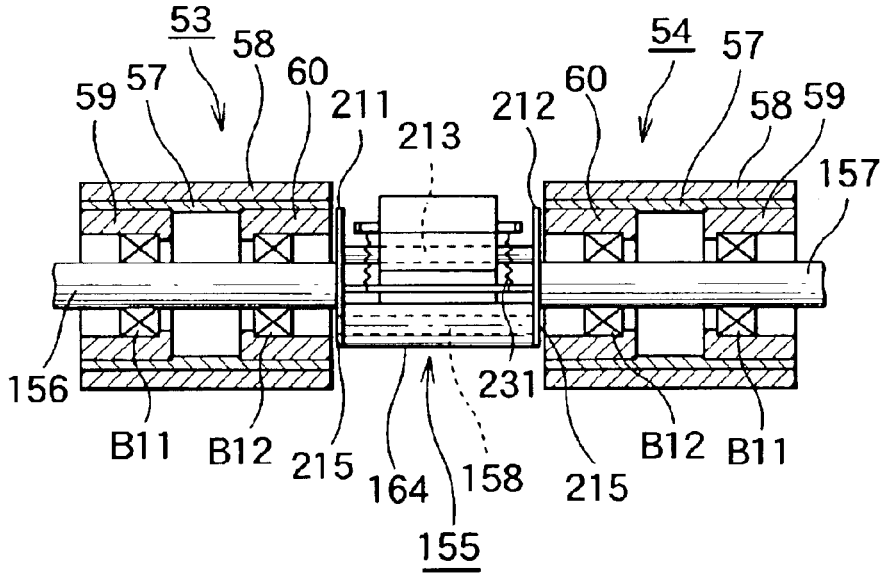
FIG. 11 is a longitudinal cross section of the second squeeze roller used in a fifth embodiment of the present invention.
Figure 12:
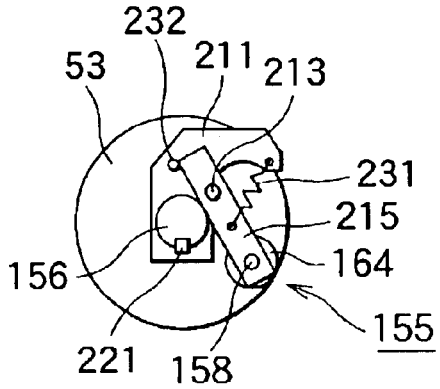
FIG. 12 is a transverse cross section of the second squeeze roller used in the fifth embodiment of the present invention.

FIG. 11 is a longitudinal cross section of the second squeeze roller used in the fifth embodiment of the present invention. FIG. 12 is a transverse cross section of the second squeeze roller used in the fifth embodiment of the present invention.

In the present embodiment, brackets 211 and 212 are connected to the shafts 156 and 157, respectively, via keys 221; and a pivot shaft 213 is disposed to extend between the brackets 211 and 212. The pivot shaft 213 and the shaft 158 are connected to each other via a pair of arms 215; and a retractable roller portion 155 is rotatably supported by the shaft 158. Springs 231 serving as elastic bodies urge the arms 215 toward a direction for pressing the retractable roller portion 155 against the first squeeze roller 23 (FIG. 3). Therefore, the tubular sleeve 164 is supported in a floating state to be movable relative to the shafts 156 and 157, and urged toward the packaging material 11. Reference numeral 232 denotes a stopper for defining the pivot range of the arms 215.

Next, a sixth embodiment of the present invention will be described. Components having the same structures as those in the second embodiment are denoted by the same reference numerals, and repeated descriptions thereof are omitted.

Figure 13:
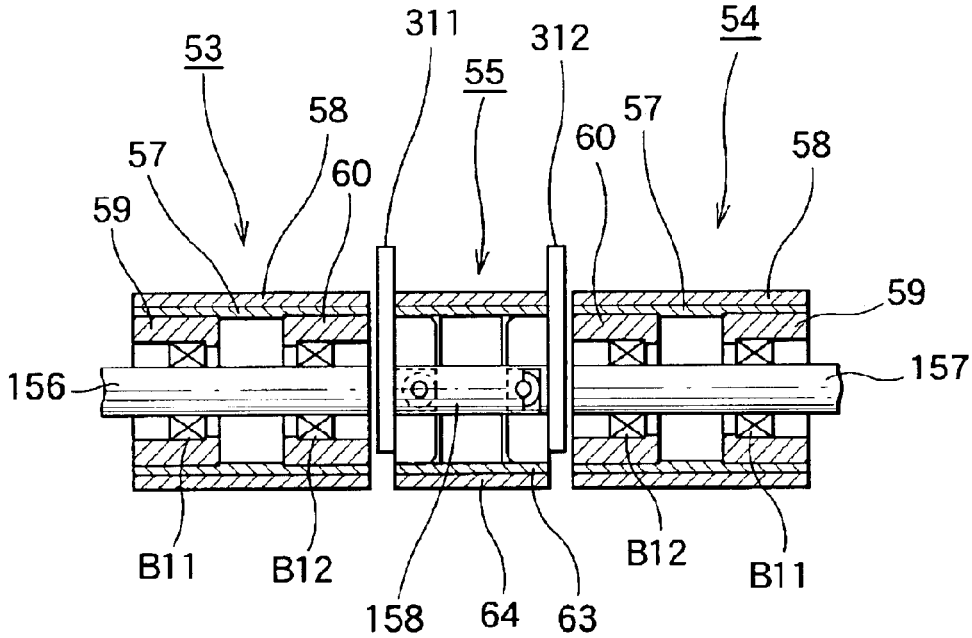
FIG. 13 is a longitudinal cross section of the second squeeze roller used in a sixth embodiment of the present invention.
Figure 14:
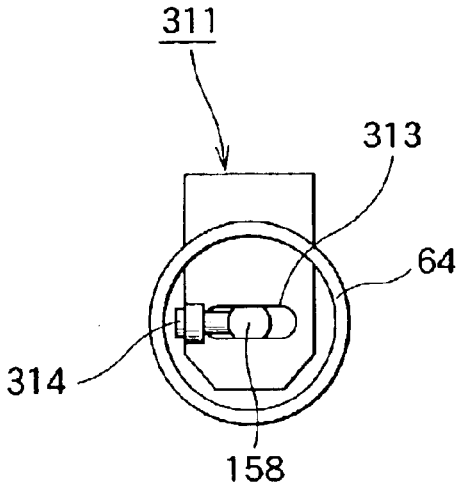
FIG. 14 is a transverse cross section of the second squeeze roller used in the sixth embodiment of the present invention.

FIG. 13 is a longitudinal cross section of the second squeeze roller used in the sixth embodiment of the present invention. FIG. 14 is a transverse cross section of the second squeeze roller used in the sixth embodiment of the present invention.

In the present embodiment, brackets 311 and 312 are disposed between the main roller portions 53 and 54; and the shaft 158 is fitted into elongated grooves 313 formed in the brackets 311 and 312, so that the shaft 158 is supported by the bracket 311 and 312 to be movable along a predetermined direction (along a horizontal direction in the present embodiment). An actuator 314 serving as an elastic body is attached to the shaft 158 in order to urge the shaft 158 in a direction for pressing the retractable roller portion 55 against the first squeeze roller 23 (FIG. 3). Therefore, the sleeve 64 is supported in a floating state to be movable relative to the shafts 156 and 157, and urged toward the packaging material 11.

The present invention is not limited to the above-described embodiments. Numerous modifications and variations of the present invention are possible in light of the spirit of the present invention, and they are not excluded from the scope of the present invention.

INDUSTRIAL APPLICABILITY

The present invention can be applied to a filling machine for manufacturing packaging containers.

What is claimed is:

1. A liquid-removing apparatus characterized by comprising:

(a) a packaging material having a projection formed at a predetermined position;

(b) first and second squeeze rollers which form a squeeze portion for removing liquid adhering to the packaging material; and (c) an elastic body, wherein (d) the second squeeze roller has a main roller portion and a retractable roller portion which retracts when the projection reaches the squeeze portion, and (e) the elastic body urges a tubular sleeve provided on the retractable roller portion toward the packaging material.

2. A liquid-removing apparatus according to claim 1, wherein the retractable roller portion is disposed between a pair of the main roller portions.

3. A liquid-removing apparatus according to claim 1, wherein the sleeve is supported by the elastic body in a floating state.

4. A liquid-removing apparatus according to claim 2, wherein the elastic body is disposed between the sleeve and a support member of each main roller portion.

5. A liquid-removing apparatus according to claim 1, wherein the main roller portion and the retractable roller portion are rotatably supported on a common shaft.

6. A liquid-removing apparatus according to claim 1, wherein the main roller portion and the retractable roller portion have individual shafts disposed independently of one another.

7. A liquid-removing apparatus according to claim 1, wherein the retractable roller portion is pivoted about a pivot shaft serving as a pivoting center.

8. A liquid-removing apparatus according to claim 1, wherein a shaft of the retractable roller portion is supported to be movable along a predetermined direction.

* * * * *